US010066612B2

(12) United States Patent
Bean et al.

(10) Patent No.: US 10,066,612 B2
(45) Date of Patent: Sep. 4, 2018

(54) METHOD OF OPERATING CRYOGENIC PUMP AND CRYOGENIC PUMP SYSTEM

(71) Applicant: Caterpillar Inc., Peoria, IL (US)

(72) Inventors: Sunil J. Bean, Peoria, IL (US); Cory A. Brown, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 472 days.

(21) Appl. No.: 14/788,988

(22) Filed: Jul. 1, 2015

(65) Prior Publication Data

US 2017/0002800 A1 Jan. 5, 2017

(51) Int. Cl.

| | |
|---|---|
| ***F04B 15/08*** | (2006.01) |
| ***F04B 37/08*** | (2006.01) |
| ***F04B 9/107*** | (2006.01) |
| ***F04B 49/06*** | (2006.01) |
| ***F04B 49/22*** | (2006.01) |
| ***F04B 53/14*** | (2006.01) |
| ***F04B 53/10*** | (2006.01) |
| ***F04B 53/16*** | (2006.01) |
| ***F04B 23/02*** | (2006.01) |
| ***F04B 23/06*** | (2006.01) |

(52) U.S. Cl.

CPC ..... *F04B 15/08* (2013.01); *F04B 9/107* (2013.01); *F04B 23/02* (2013.01); *F04B 23/06* (2013.01); *F04B 37/08* (2013.01); *F04B 49/06* (2013.01); *F04B 49/22* (2013.01); *F04B 53/10* (2013.01); *F04B 53/14* (2013.01); *F04B 53/16* (2013.01); *F04B 2015/081* (2013.01); *Y10S 417/901* (2013.01)

(58) Field of Classification Search

CPC ..... F04B 15/08; F04B 37/08; Y10S 417/901

See application file for complete search history.

(56) References Cited

U.S. PATENT DOCUMENTS

| | | | |
|---|---|---|---|
| 7,185,614 | B2 | 3/2007 | Meffert et al. |
| 7,219,649 | B2 | 5/2007 | Duffy et al. |
| 7,422,000 | B2 | 9/2008 | Kesse et al. |
| 7,685,809 | B2 | 3/2010 | Driscoll et al. |
| 8,121,774 | B2 | 2/2012 | Kesse et al. |
| 8,511,075 | B2 | 8/2013 | Brown et al. |
| 8,850,803 | B2 | 10/2014 | Brown |
| 8,857,162 | B2 | 10/2014 | Brown et al. |
| 8,977,473 | B2 | 3/2015 | Brown |
| 8,997,720 | B2 | 4/2015 | Brown et al. |
| 2002/0104581 | A1 | 8/2002 | Drube et al. |
| 2004/0053316 | A1 | 3/2004 | Emmer et al. |
| 2004/0105759 | A1 | 6/2004 | Gram et al. |
| 2006/0090726 | A1 | 5/2006 | Meffert et al. |
| 2007/0006842 | A1 | 1/2007 | Kesse et al. |

(Continued)

*Primary Examiner* — Peter J Bertheaud

(74) *Attorney, Agent, or Firm* — Leydig, Voit & Mayer, LTD.

(57) ABSTRACT

A cryogenic pump system includes a supply of liquid natural gas, a source of hydraulic fluid, a cryogenic pump, and an electronic control module. The cryogenic pump is operatively arranged with the supply of liquid natural gas and the source of hydraulic fluid. The cryogenic pump is configured to operate using the source of hydraulic fluid to compress at least some of the supply of liquid natural gas for delivery to an engine. The electronic control module is operably arranged with the cryogenic pump and configured to selectively operate the cryogenic pump. Control strategies for operating the cryogenic pump system are disclosed which have reduced power demands.

14 Claims, 10 Drawing Sheets

(56) References Cited

U.S. PATENT DOCUMENTS

| | | | |
|---|---|---|---|
| 2007/0028890 | A1 | 2/2007 | Brown et al. |
| 2007/0031271 | A1 | 2/2007 | Claude et al. |
| 2007/0034188 | A1 | 2/2007 | Duffy et al. |
| 2007/0092426 | A1 | 4/2007 | Driscoll et al. |
| 2008/0035187 | A1 | 2/2008 | Brown et al. |
| 2008/0296412 | A1 | 12/2008 | Gibson et al. |
| 2010/0071355 | A1 | 3/2010 | Brown et al. |
| 2010/0199959 | A1 | 8/2010 | Brown et al. |
| 2012/0073270 | A1 | 3/2012 | Cox et al. |
| 2012/0187218 | A1 | 7/2012 | Kim et al. |
| 2012/0255523 | A1 | 10/2012 | Kim et al. |
| 2012/0285417 | A1 | 11/2012 | Kim et al. |
| 2013/0047964 | A1 | 2/2013 | Kim |
| 2013/0048750 | A1 | 2/2013 | Kim et al. |
| 2013/0098333 | A1 | 4/2013 | Kim et al. |
| 2013/0160741 | A1 | 6/2013 | Sommars et al. |
| 2013/0160742 | A1 | 6/2013 | Brown et al. |
| 2013/0319373 | A1 | 12/2013 | Brown et al. |
| 2014/0020773 | A1 | 1/2014 | Sommars et al. |
| 2014/0034019 | A1 | 2/2014 | Mittal et al. |
| 2014/0034023 | A1 | 2/2014 | Coldren |
| 2014/0067234 | A1 | 3/2014 | Brown |
| 2014/0069387 | A1 | 3/2014 | Brown et al. |
| 2014/0091159 | A1 | 4/2014 | Brown et al. |
| 2014/0123626 | A1 | 5/2014 | Brown et al. |
| 2014/0123936 | A1 | 5/2014 | Kim et al. |
| 2014/0123948 | A1 | 5/2014 | Mittal |
| 2014/0130778 | A1 | 5/2014 | Puckett et al. |
| 2014/0150422 | A1 | 6/2014 | Brown et al. |
| 2014/0157764 | A1 | 6/2014 | Brown |
| 2014/0158224 | A1 | 6/2014 | Brown |
| 2014/0165966 | A1 | 6/2014 | Brown et al. |
| 2014/0172269 | A1 | 6/2014 | Perry |
| 2014/0182551 | A1 | 7/2014 | Steffen |
| 2014/0182552 | A1 | 7/2014 | Brown et al. |
| 2014/0196686 | A1 | 7/2014 | Coldren et al. |
| 2014/0196687 | A1 | 7/2014 | Coldren et al. |
| 2014/0202429 | A1 | 7/2014 | Grant et al. |
| 2014/0238350 | A1 | 8/2014 | Fiveland et al. |
| 2014/0238353 | A1 | 8/2014 | Brown et al. |
| 2014/0241913 | A1 | 8/2014 | Puckett |
| 2014/0311455 | A1 | 10/2014 | Kim et al. |
| 2014/0331963 | A1 | 11/2014 | Grant et al. |
| 2014/0338639 | A1 | 11/2014 | Brown |
| 2015/0047614 | A1 | 2/2015 | Kim et al. |

METHOD OF OPERATING CRYOGENIC PUMP AND CRYOGENIC PUMP SYSTEM

TECHNICAL FIELD

This patent disclosure relates generally to a pump system and, more particularly, to a cryogenic pump system and methods of operating the same.

BACKGROUND

It has become increasingly common for machines used in agricultural, construction and mining operations to be powered by alternative fuels. The use of liquid natural gas (LNG) for powering movable machines is becoming increasingly popular. Among other things, LNG engines have a reduced carbon output and thus are viewed as more environmentally friendly than conventional diesel and other internal combustion engines powered by gasoline. In addition, given the prevalence of LNG, the cost associated with such fuel is typically lower than other fuel products, and, thus, consumer demand for such machines is increasing.

In order to provide the natural gas to the engine in a portable, efficient manner, the natural gas is cooled to a liquid state and stored on board the machine in a cryogenic tank (cryo-tank). Such tanks are typically double-walled with insulation between the walls in order to maintain the natural gas at a cold temperature and under pressure (such as, at −160° C. and lower, and at pressures at least as high as 300 psi, for example). A pump is then used to deliver the LNG to the engine of the machine. Such pumps, also referred to as a cryogenic pump, are typically provided as piston pumps, which not only deliver the LNG to the engine but also pressurize the LNG to convert it to compressed natural gas (CNG). For example, LNG is typically stored at a pressure of about 300 psi, and CNG is typically at least an order of magnitude greater, such as, about 6000 psi, for example.

U.S. Patent Application Publication No. US2007/0031271 is entitled, "Effervescent Gas Bleeder Apparatus," and is directed to a diaphragm metering pump suitable for metering an effervescent gas. The pump has a pump head with a product chamber having an inlet end with a one-way inlet valve and an outlet end with a one-way outlet valve. A displaceable diaphragm member defines a boundary of the product chamber. The diaphragm member is capable of being reciprocated to cause pumping displacements. A discharge side is disposed downstream from the outlet valve. A passageway is disposed in fluid communication between the discharge side and the product chamber. A valve is disposed in the passageway. The valve is opened intermittently to allow liquid to re-enter the product chamber in an amount effective to purge gas from the product chamber to prevent loss of prime.

There is a continued need in the art to provide additional solutions to enhance the performance of components of a cryogenic pump system. For example, a cryogenic pump system used on a mobile application preferably meets stringent life and performance requirements to satisfy customer expectations. Furthermore, in mobile applications, the available options for powering the cryogenic pump system are limited, and the cryogenic pump system is just one of many subsystems of a mobile machine vying for a limited power supply. As such, there is a continued need to provide a cryogenic pump system which uses robust control components that can withstand the rigors of the environment within which mobile machines can be used, yet have reduced power demands.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a method of operating a cryogenic pump. The method of operating includes energizing a hydraulic pilot actuator in fluid communication with a spool valve to move the spool valve from a drain position to an extended fill position. The spool valve is biased to the drain position.

In response to the spool valve being displaced from the drain position, a pump flow of hydraulic fluid is directed through the spool valve to a drive cylinder such that the pump flow of hydraulic fluid acts against a drive piston reciprocally disposed within the drive cylinder to move the drive piston from a retracted position to an extended pump position. The drive piston is linked to a cryo-plunger assembly which is in communication with a supply of liquid natural gas. In response to the drive piston moving to the extended pump position, the cryo-plunger assembly is actuated to perform a pump stroke to compress at least some of the supply of liquid natural gas.

The hydraulic pilot actuator is de-energized after an energizing period of time has elapsed. A rate of spool return of the spool valve from the extended fill position to the drain position is controlled after the hydraulic pilot actuator is de-energized such that the drive piston is in the extended pump position after a dwell period of time after the energizing period of time has elapsed.

The extended fill position is further from the drain position than a reference fill position of the spool valve. The reference fill position is located such that the drive piston is in the extended pump position with the hydraulic pilot actuator being energized throughout a reference period of time. The reference period of time is equal to a combined sum of the energizing period of time and the dwell period of time.

In yet another embodiment, a method of operating a cryogenic pump is described. The method of operating includes energizing a hydraulic pilot actuator for a plurality of energizing periods of time. The hydraulic pilot actuator is in fluid communication with a spool valve such that the spool valve moves in a fill direction from a drain position toward an extended fill position during the plurality of energizing periods of time. The spool valve is biased to the drain position.

An intervening dwell period of time is allowed to elapse between each successive pair of the plurality of energizing periods of time. The hydraulic pilot actuator is un-energized during each intervening dwell period of time. The spool valve moves in a drain direction from the extended fill position toward the drain position during each intervening dwell period of time.

In response to the spool valve being displaced from the drain position, a pump flow of hydraulic fluid is directed through the spool valve to a drive cylinder such that the pump flow of hydraulic fluid acts against a drive piston reciprocally disposed within the drive cylinder to move the drive piston from a retracted position to an extended pump position. The drive piston is linked to a cryo-plunger assembly. The cryo-plunger assembly is in communication with a supply of liquid natural gas. In response to the drive piston moving to the extended pump position, the cryo-plunger assembly is actuated to perform a pump stroke to compress at least some of the supply of liquid natural gas.

The hydraulic pilot actuator is de-energized after a final energizing period of the plurality of energizing periods of time has elapsed. The plurality of energizing periods of time and each intervening dwell period of time are configured such that the drive piston is in the extended pump position after a residual dwell period of time has elapsed. The residual dwell period of time occurs after the final energizing period of the plurality of energizing periods of time has elapsed.

The extended fill position is further from the drain position than a reference fill position of the spool valve in which the drive piston is in the extended pump position after the hydraulic pilot actuator is energized throughout a reference period of time. The reference period of time is equal to a combined sum of the plurality of energizing periods of time, each intervening dwell period of time, and the residual dwell period of time.

In still another embodiment, a cryogenic pump system includes a supply of liquid natural gas, a source of hydraulic fluid, a cryogenic pump, and an electronic control module. The cryogenic pump is operatively arranged with the supply of liquid natural gas and the source of hydraulic fluid. The cryogenic pump is configured to operate using the source of hydraulic fluid to compress at least some of the supply of liquid natural gas. The electronic control module is operably arranged with the cryogenic pump and is configured to selectively operate the cryogenic pump.

The cryogenic pump includes a spool valve, a hydraulic pilot actuator, a drive cylinder, a drive piston, and a cryo-plunger assembly. The spool valve is movable over a range of travel between a drain position and an extended fill position. The spool valve is biased to the drain position. The spool valve is in communication with the source of hydraulic fluid.

The hydraulic pilot actuator is in fluid communication with the source of hydraulic fluid and the spool valve. The hydraulic pilot actuator is in electrical communication with the electronic control module. The hydraulic pilot actuator is configured, in response to receiving a command signal from the electronic control module, to direct a pilot flow of hydraulic fluid to move the spool valve from the drain position to the extended fill position.

The drive cylinder is in fluid communication with the spool valve. The drive piston is reciprocally disposed within the drive cylinder. The drive piston is reciprocally movable between a retracted position and an extended pump position. The drive piston is biased to the retracted position, wherein, in response to the spool valve being displaced from the drain position, a pump flow of hydraulic fluid is directed through the spool valve to the drive cylinder such that the pump flow of hydraulic fluid acts against the drive piston to move the drive piston from the retracted position to the extended pump position.

The cryo-plunger assembly is in communication with the supply of liquid natural gas. The cryo-plunger assembly is operably linked to the drive piston such that, in response to the drive piston moving to the extended pump position, the cryo-plunger assembly is actuated to perform a pump stroke to compress at least some of the supply of liquid natural gas.

Further and alternative aspects and features of the disclosed principles will be appreciated from the following detailed description and the accompanying drawings. As will be appreciated, the principles related to internal combustion engines, cryogenic pump systems, and methods of operating a cryogenic pump disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

Figure 1:
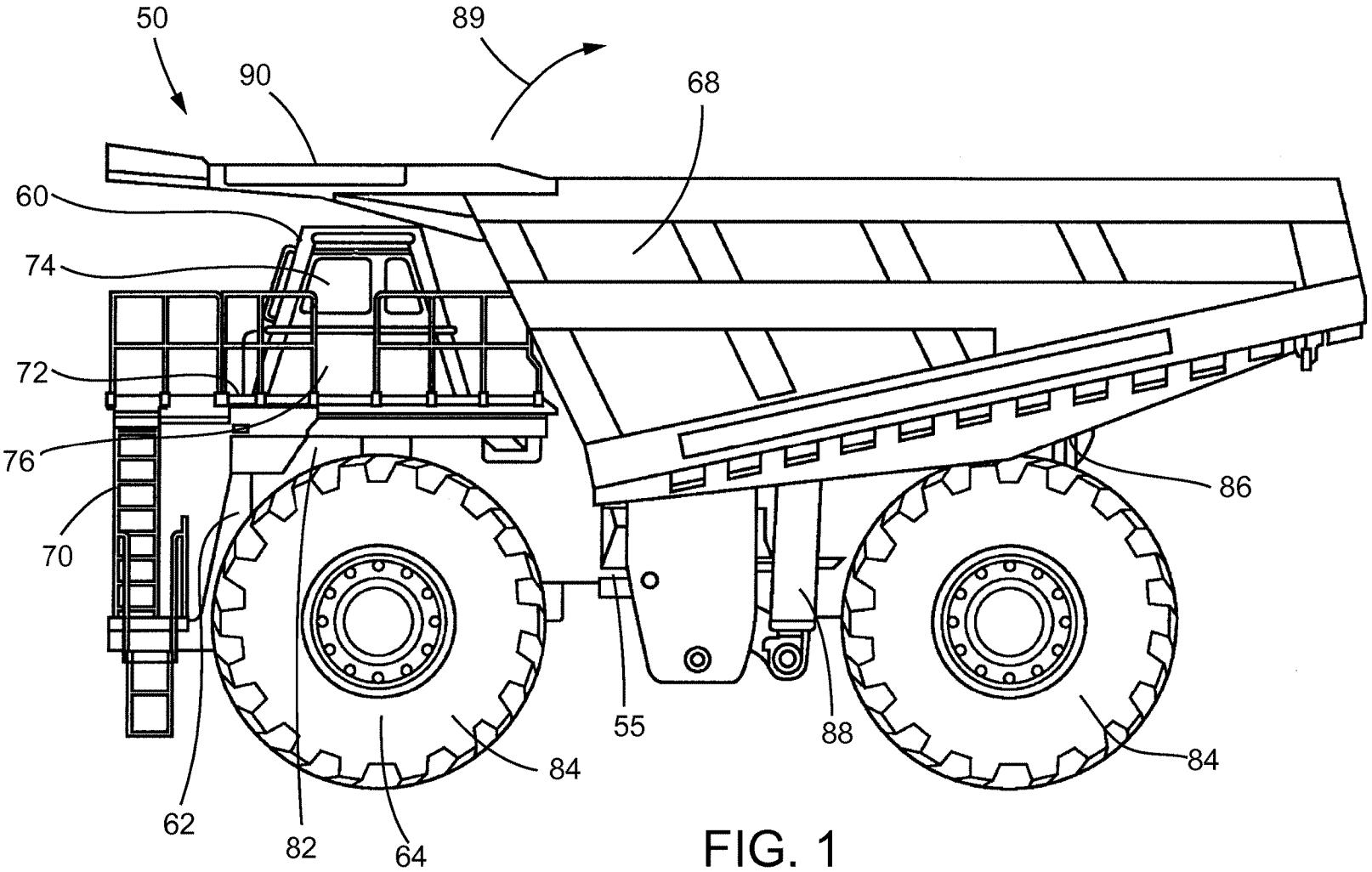
FIG. 1 is a diagrammatic side view of an embodiment of a machine in the form of a large mining truck suitable for use with an embodiment of a cryogenic pump system constructed in accordance with principles of the present disclosure.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

The present disclosure provides embodiments of a cryogenic pump system for an engine and methods of operating the same. An exemplary engine comprises a dual fuel compression ignition engine, for example. In embodiments, the engine is used in a mobile machine, such as, a large mining truck, for example.

Embodiments of a cryogenic pump system constructed according to principles of the present disclosure can incorporate a spool valve control for actuating a hydraulic plunger in the cryogenic pump. In embodiments, a "warm end" of a cryogenic pump includes control components which use hydraulic fluid as the working fluid to control pump components in a "cold end" of the cryogenic pump associated with a supply of LNG. Robust control components can be used in the warm end to actuate the pumping in the cold end of the cryogenic pump. Various embodiments of a cryogenic pump control strategy can be employed to reduce the power draw of the cryogenic pump system. The reduced demand on the power supply can be particularly helpful in applications where the cryogenic pump system is used in a mobile machine and can help reduce the harm to components of the cryogenic pump system caused by excessive heating thereof (e.g., the solenoid of a hydraulic pilot actuator).

For example, in a typical strategy, a pilot valve is actuated and held at a fill position for the entirety of a pump stroke of the cryogenic pump (e.g., a 30 ms pump stroke). The fill position can be established at a point which generates sufficient displacement to actuate the pumping element. In embodiments following principles of the present disclosure, a hydraulic pilot actuator is actuated for only a portion of the duration of a typical actuation period of the pump stroke. In embodiments, a spool valve is configured to move over a range of travel between a drain position and an extended fill position such that the spool valve is configured to move with an increased spool lift to allow for adequate hydraulic flow over the span of the typical actuation period, but with reduced power usage. In embodiments, the power demand for the cryogenic pump is reduced by one half or more per pumping event.

In embodiments, a shorter duration pilot actuation is combined with an orifice-controlled, reduced-rate spool return in which the spool valve does not diminish nominal hydraulic flow to the pumping element until the pumping event is complete. In embodiments, the spool valve is opened by moving with an increased spool lift to an extended fill position. The return of the spool valve to the drain position can be slowed by an orifice, for example, which controls the flow of hydraulic fluid that returns the spool valve to the drain position. Once the solenoid of the hydraulic pilot actuator is de-energized at an intermediate point in time of the pump stroke, the spool valve can gradually return from the extended fill position, moving back toward the drain position over the remainder of the pump stroke.

In other embodiments, a series of pilot actuation bursts are combined with an increased spool lift to an extended fill position. In embodiments, the control strategy includes multiple shorter pilot actuation shots that oscillate the spool valve between the extended fill position and a minimum fill position required to actuate the pumping element before allowing it to return to the drain position to cut off hydraulic flow to the pumping element. In embodiments, any suitable number of actuation bursts can be used (e.g., two or more actuation bursts).

Turning now to the FIGURES, there is shown in FIG. 1 an exemplary embodiment of a machine 50 in the form of a large mining truck. In the illustrated embodiment, the machine is a large self-propelled off-highway vehicle capable of carrying tons of material in operations such as mining and the like. The machine 50 has a chassis 55 which supports an operator station 60, a power system 62, a drive system 64, and a dump body 68.

In other embodiments, the machine 50 can be any other suitable machine for use with a cryogenic pump system constructed in accordance with principles of the present disclosure. Examples of such machines include mobile or fixed machines used for construction, farming, mining, forestry, transportation, and other similar industries. In some embodiments, the machine can be an excavator, wheel loader, backhoe, crane, compactor, dozer, wheel tractor-scraper, material-handling machine, or any other suitable machine which includes a cryogenic pump system.

The operator station 60 includes controls for operating the machine 50 via the power system 62. The operator station 60 is accessible by an operator by way of a ladder 70 and a catwalk 72. The illustrated operator station 60 is configured to define an interior cabin 74 within which the operator controls are housed and which is accessible via a door 76. Specifically, the operator station 60 can include one or more operator interface devices configured for use by a machine operator to maneuver the machine 50 and perform tasks with the machine 50, for example. Examples of operator interface devices include, but are not limited to, a joystick, a steering wheel, and/or a pedal as are well known and understood in the industry.

The power system 62 is configured to supply power to the machine 50. The power system 62 is operably arranged with the operator station 60 to receive control signals from the controls in the operator station 60 and with the drive system 64 and the dump body 68 to selectively operate these components 64, 68 according to control signals received from the operator station 60. The power system 62 is adapted to provide operating power for the propulsion of the drive system 64 and the operation of the dump body 68 as is understood by those having ordinary skill in the art.

In embodiments, the power system 62 can include an engine 80 (see FIG. 2), a cooling system or package, a transmission, and a hydraulic system, for example, housed at least in part within an engine compartment 82 supported by the chassis 55. The cooling system can be configured to cool the engine(s) of the power system 62.

In embodiments, the engine 80 can be any suitable engine. In embodiments, the power system 62 can include a number of engines 80. In embodiments, the engine 80 can be partially, or entirely, powered by liquid natural gas (LNG). In embodiments, any suitable LNG can be used, such as, methane or other suitable gases, as will be understood by one skilled in the art.

The hydraulic system can include a plurality of components such as pumps (including an embodiment of a cryogenic pump system 100 constructed according to principles of the present disclosure), valves, and conduits, along with a hydraulic fluid reservoir (not shown). The hydraulic system, as well as other systems in the machine 50, can include its own cooling arrangement.

Referring to FIG. 1, the drive system 64 is in operable arrangement with the power system 62 to selectively propel the machine 50 via control signals sent through the operator station 60. The drive system 64 can include a plurality of ground-engaging members, such as, wheels 84 as shown in the illustrated embodiment, which can be movably connected to the chassis 55 through axles, drive shafts or other components (not shown). In embodiments, the drive system 64 can be provided in the form of a track-drive system, a wheel-drive system, or any other type of drive system configured to propel the machine 50.

The dump body 68 defines a storage compartment configured to carry a payload, such as mined material, for example, within it. The dump body 68 is pivotably attached to the chassis 55 toward a rear end 86 of the dump body 68. The dump body 68 is pivotably movable by way of one or more hydraulic cylinders 88 over a range of travel between a storage position (shown in FIG. 1) and a fully-inclined dumping position (as indicated by arrow 89).

The dump body 68 includes a canopy 90 that extends outwardly from the dump body 68 when the dump body 68 is in the storage position, as shown in FIG. 1. When the dump body 68 is in the storage position, the canopy 90 extends over the operator station 60 and is configured to protect the operator station 60 from debris falling overhead during loading of the dump body 68.

In other embodiments, a different style of dump body 68 can be used. For example, in embodiments, the dump body 68 can include a tailgate at the rear end 86 thereof which is adapted to move between an open position and a closed position. In other embodiments, the machine 50 can have a different form. For example, in embodiments, the machine can comprise a locomotive.

Figure 2:
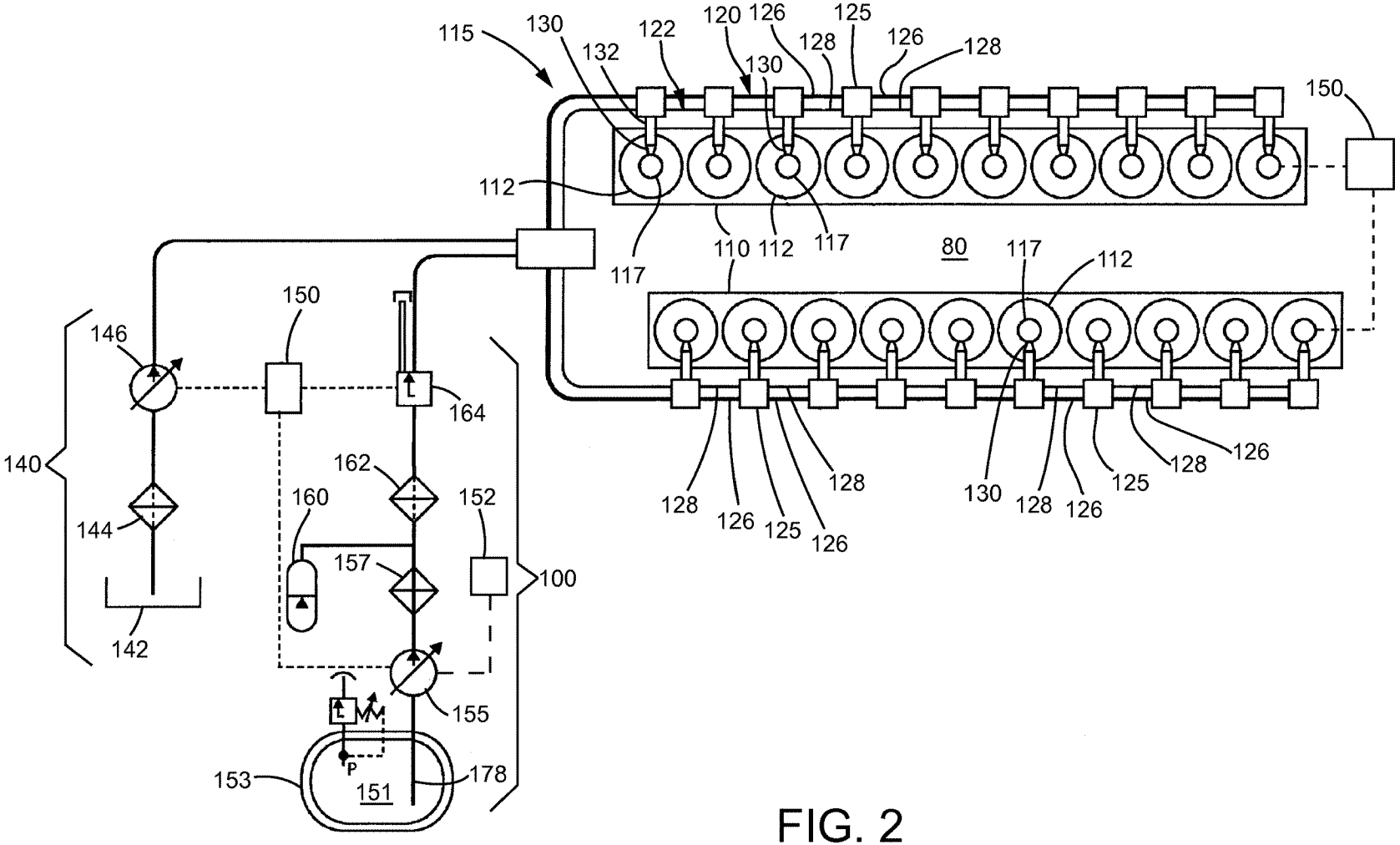
FIG. 2 is a schematic view of an engine suitable for use with an embodiment of a cryogenic pump system constructed in accordance with principles of the present disclosure.

Referring to FIG. 2, the illustrated engine 80 comprises a dual fuel compression ignition engine. The engine 80 can be supported on the chassis 55 of the machine 50 in a manner well known in the art. The engine 80 can operate by compression igniting a small quantity of liquid diesel fuel to in turn ignite a larger charge of natural gas. In other embodiments, the engine 80 can be operated solely by natural gas.

The illustrated dual fuel engine 80 includes an engine housing 110 that defines a plurality of engine cylinders 112. In the illustrated embodiment, the engine 80 includes twenty engine cylinders 112. In embodiments, the engine 80 can include a different number of engine cylinders 112. In the illustrated embodiment, a piston (not shown) reciprocates in each of the engine cylinders 112 to define a compression ratio suitable for compression igniting injected liquid diesel fuel.

A dual fuel common rail fuel system 115 is in fluid communication with each of the plurality of engine cylinders 112. The dual fuel common rail fuel system 115 includes a fuel injector 117 mounted for direct injection into each of the plurality of engine cylinders 112.

In embodiments, the engine 80 operates by compression igniting a small quantity of liquid diesel fuel to in turn ignite a larger charge of natural gas, with both of the fuels being supplied to each of the engine cylinders 112 by the associated fuel injector 117. The dual fuel common rail fuel system 115 includes a liquid fuel common rail 120 and a gaseous fuel common rail 122 which are both fluidly connected to each fuel injector 117. In the illustrated embodiment, the liquid fuel common rail 120 contains liquid diesel fuel, and the gaseous fuel common rail 122 contains compressed natural gas fuel (CNG) which has been pressurized by the cryogenic pump system 100 (e.g., to a pressure of about 40 MPa). In the illustrated embodiment, the liquid fuel common rail 120 and the gaseous fuel common rail 122 are made up of a plurality of daisy chained blocks 125 that are connected in series with liquid fuel lines 126 and gaseous fuel lines 128.

In embodiments, any suitable fuel injector 117 can be used. For example, in embodiments, each fuel injector 117 can define a first nozzle outlet set for injecting liquid fuel, and a second nozzle outlet set for injecting gaseous fuel. In the illustrated embodiment, the liquid fuel common rail 120 and the gaseous fuel common rail 122 are fluidly connected to each of the fuel injectors 117 via a common conical seat 130. For instance, in embodiments, the liquid fuel common rail 120 and the gaseous fuel common rail 122 can be fluidly connected to each of the fuel injectors 117 via a co-axial quill assembly 132. The liquid and gaseous fuels can be supplied to each of the fuel injectors 117 with a coaxial quill assembly 132 that includes an inner quill (not shown) that is positioned within an outer quill (not shown) in a manner well understood by one skilled in the art. Liquid fuel can be supplied to the fuel injector 117 through the inner quill, and gaseous fuel can be supplied to the fuel injector 117 in the cavity defined between the inner quill and the outer quill. In other embodiments, different fluid connections can be provided.

A liquid fuel supply system 140 can be provided to selectively supply pressurized liquid fuel to the liquid fuel common rail 120. In embodiments, any suitable liquid fuel supply system 140 can be used. In the illustrated embodiment, the liquid fuel supply system 140 includes a fuel tank 142, a filter 144, and a high pressure pump 146.

An electronic control module 150 can be in electrical communication with the engine 80, the liquid fuel supply system 140, and the cryogenic pump system 100. In embodiments, the electronic control module 150 can be configured to control the output of the high pressure pump 146 of the liquid fuel supply system 140 (and, thus, the pressure in liquid fuel common rail 120) in any suitable manner, as will be appreciated by one skilled in the art. The electronic control module 150 can also be configured to control the timing and duration of both liquid and gaseous fuel injection events from the fuel injectors 117 in any suitable manner, as will be appreciated by one skilled in the art.

The cryogenic pump system 100 is configured to supply CNG to the gaseous fuel common rail 122. The illustrated cryogenic pump system 100 includes a supply of LNG 151, a source of hydraulic fluid 152, a cryo-tank 153, a cryogenic pump 155, a heat exchanger 157, an accumulator 160, a filter 162, a fuel conditioning module 164, and the electronic control module 150. The supply of liquid natural gas 151 is stored in the cryo-tank 153. The cryogenic pump 155 is operatively arranged with the supply of liquid natural gas 151 and the source of hydraulic fluid 152. The cryogenic pump 155 is configured to operate using the source of hydraulic fluid 152 to compress at least some of the supply of liquid natural gas 151. The electronic control module 150 is operably arranged with the cryogenic pump 155 and is configured to selectively operate the cryogenic pump 155. In embodiments, the electronic control module 150 can be configured to control the pressure in gaseous fuel common rail 122 by way of the fuel conditioning module 164.

Figure 3:
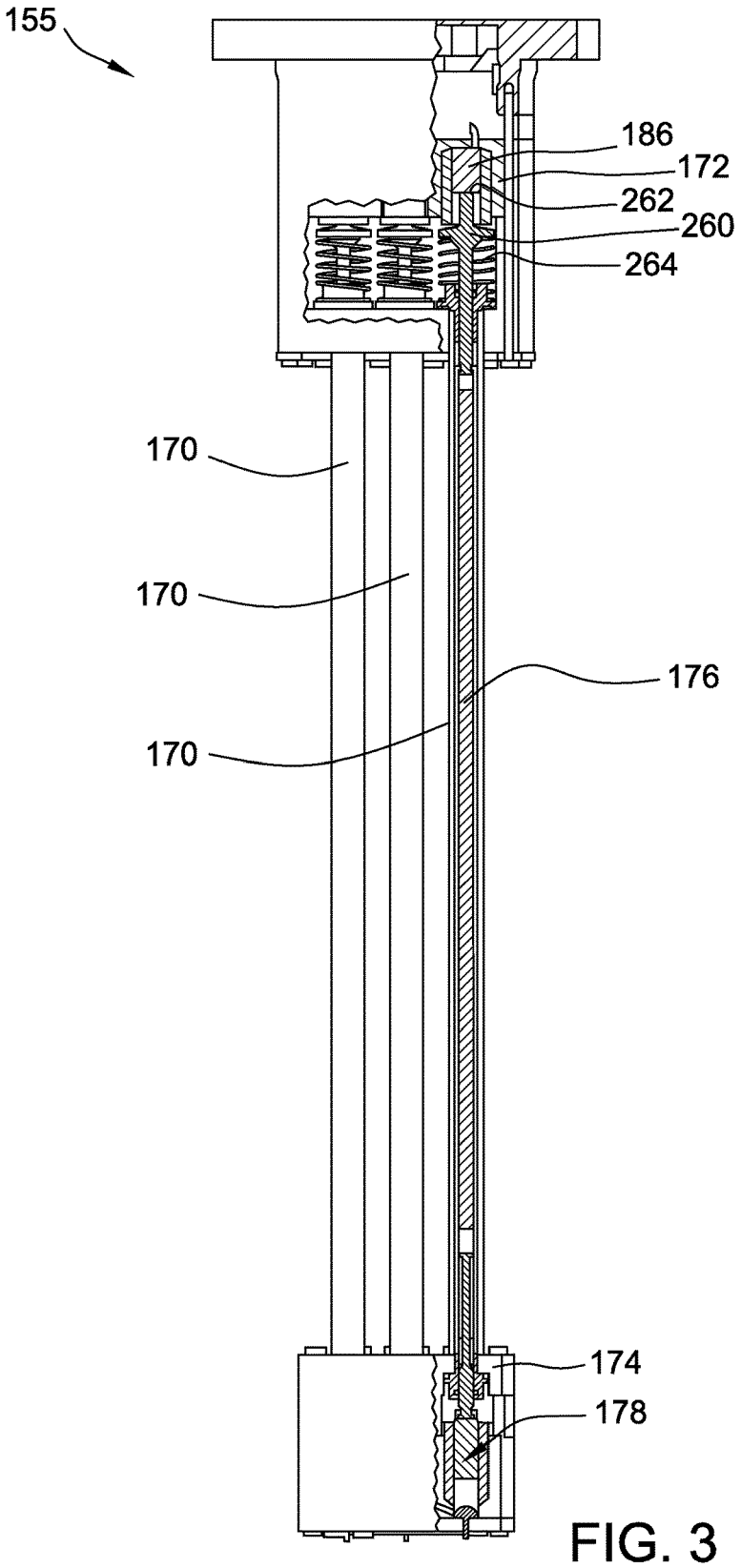
FIG. 3 is a schematic side view, partially in section, of an embodiment of a cryogenic pump suitable for use in an embodiment of a cryogenic pump system constructed in accordance with principles of the present disclosure.

Referring to FIG. 3, the cryogenic pump 155 can include a plurality of pump elements 170. Each pump element 170 is substantially the same. Accordingly, it will be understood that the description of one pump element 170 is applicable to each of the other pump elements 170, as well. The illustrated cryogenic pump 155 includes six pump elements 170. In other embodiments, the cryogenic pump 155 can have a different number of pump elements 170. The electronic control module 150 can be configured to operate each pump element 170 independently and with a variety of different timing sequences in different embodiments.

Each pump element 170 of the cryogenic pump 155 includes a warm end 172 and a cryogenic gas or cold end 174 connected together via a link arm 176. The warm end 172 houses various hydraulic components configured to selectively operate a cryo-plunger assembly 178 housed in the cryogenic gas end 174 via movement of the link arm 176. In the illustrated embodiment, hydraulic oil is the control fluid of the warm end 172.

Figure 4:
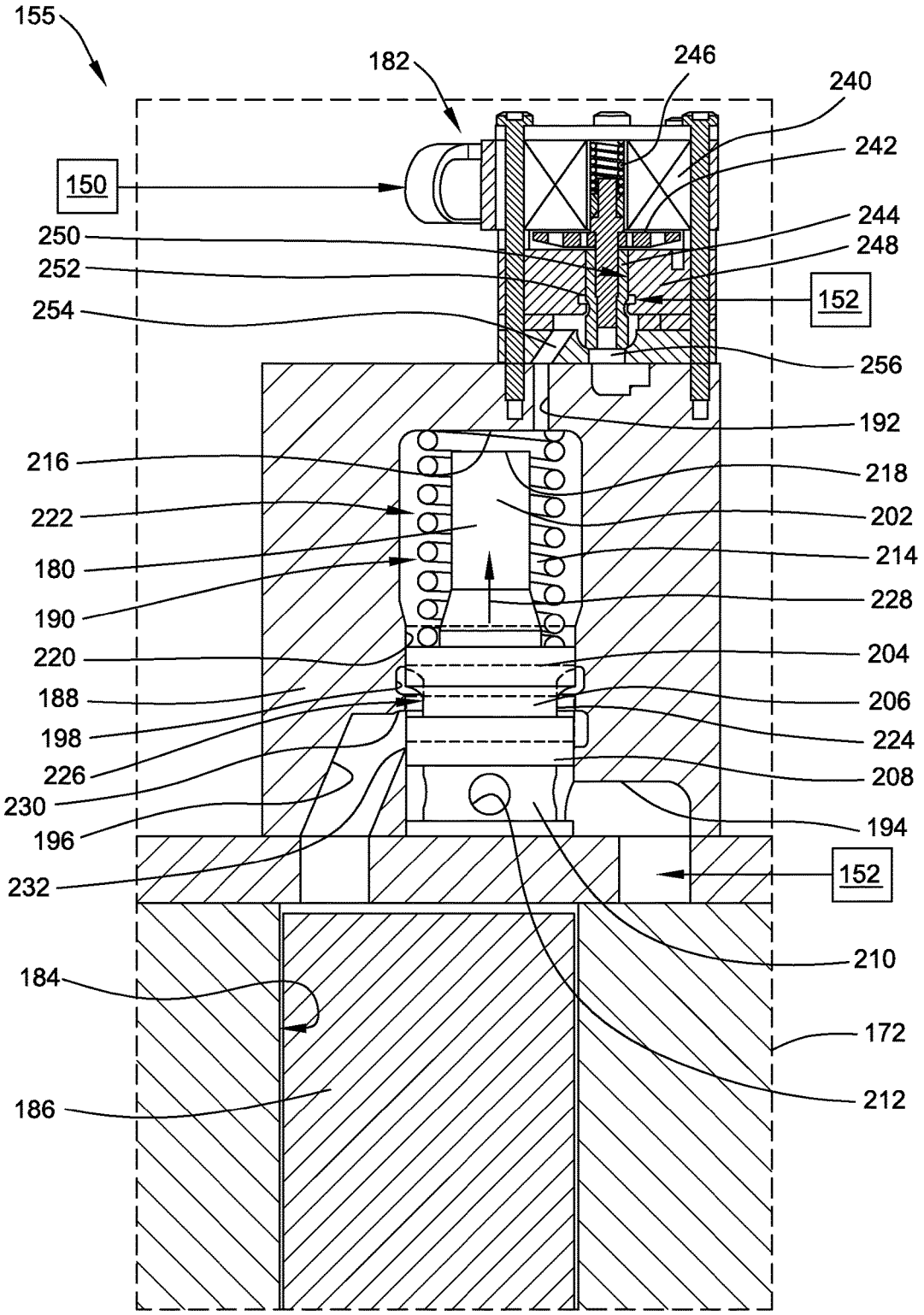
FIG. 4 is an enlarged detail view of a portion of a warm end of the cryogenic pump of FIG. 3.

Referring to FIG. 4, in the illustrated embodiment, the hydraulic components in the warm end 172 of the cryogenic pump 155 includes a spool valve 180, a hydraulic pilot actuator 182, a drive cylinder 184, and a drive piston 186. A spool block 188 defines a spool cavity 190 within which the spool valve 180 is movably disposed. The spool block 188 defines various hydraulic fluid passages, including a pilot passage 192, a pump flow passage 194, a drive piston passage 196, and a drain flow passage 198. The spool valve 180 is in communication with the hydraulic pilot actuator 182 via the pilot passage 192, with the source of hydraulic fluid 152 via the pump flow passage 194 (see also, FIG. 6), with the drive piston 186 via the drive piston passage 196, and with the hydraulic fluid drain (from which the hydraulic fluid can be re-circulated to the source of hydraulic fluid) via the drain flow passage 198 (see also, FIG. 7).

The spool valve 180 includes a proximal stem 202, a proximal pilot land 204, an intermediate drain portion 206, a distal pump land 208, and a distal pump flow end 210. The proximal stem 202, the proximal pilot land 204, the intermediate drain portion 206, and the distal pump land 208 are closed. The distal pump flow end 210 is hollow and defines a plurality of pump flow orifices 212 circumferentially arranged about the spool valve 180. The spool valve 180 is movable over a range of travel between a drain position (shown) and an extended fill position (shown partially in broken lines and in which the spool valve 180 is lifted upwardly from its drain position). In embodiments, the extended fill position can be defined by the interaction of a proximal end 218 of the proximal stem 202 of the spool valve 180 and the cavity base surface 216 of the spool block 188.

The spool valve 180 is biased to the drain position by a spool valve spring 214 disposed within the spool cavity 190. The spool valve spring 214 is interposed between a cavity base surface 216 of the spool block 188, which defines a proximal base end of the spool cavity 190, and the proximal pilot land 204 of the spool valve 180.

The proximal pilot land 204 is configured to sealingly engage a cavity sidewall surface 220 of the spool block 188 which, in conjunction with the cavity base surface 216, defines the spool cavity 190. The proximal pilot land 204 defines a pilot cavity 222 between itself and the cavity base surface 216. The pilot cavity 222 is in fluid communication with the pilot passage 192 and is substantially fluidly isolated from the pump flow passage 194, the drive piston passage 196, and the drain flow passage 198. In embodiments, the pilot cavity 222 can be configured such that, once a sufficient amount of hydraulic fluid is fed into the pilot cavity 222, the pressure exerted by the hydraulic fluid in the pilot cavity 222 maintains the spool valve 180 in the drain position and resists the lifting pressure exerted by the source of hydraulic fluid 152 fed to the pump flow passage 194.

The intermediate drain portion 206 of the spool valve 180 includes a circumferential groove 224 defined between the proximal pilot land 204 and the distal pump land 208. The intermediate drain portion 206 defines a drain cavity 226 which is in fluid communication with the drain flow passage 198 of the spool block 188. The drain cavity 226 is in selective fluid communication with the drive piston passage 196. The drain cavity 226 is in fluid communication with the drive piston passage 196 when the spool valve 180 is in the drain position (as shown in FIG. 4). Once the spool valve 180 moves in a fill direction 228 from the drain position to the extended fill position a sufficient distance for the distal pump land 208 of the spool valve 180 to fully occlude an opening 230 to the drive piston passage 196, the drain cavity 226 is substantially fluidly isolated from the drive piston passage 196.

The distal pump land 208 is configured to sealingly engage the cavity sidewall surface 220 of the spool block 188. The spool valve 180 acts to substantially fluidly isolate the pump flow passage 194 and the drain flow passage 198 from each other over the range of travel between the drain position and the extended fill position.

The distal pump land 208 is configured such that, when the spool valve 180 is in the drain position, the drive piston passage 196 is in fluid communication with the drain flow passage 198 through the spool valve 180, and the pump flow passage 194 is substantially fluidly isolated from the drive piston passage 196 via the distal pump land 208. Once the spool valve 180 moves in the fill direction 228 from the drain position toward the extended fill position a sufficient distance for the distal pump land 208 of the spool valve 180 to clear a distal edge 232 of the drive piston passage opening 230, the pump flow passage 194 and the drive piston passage 196 are in fluid communication with each other through the pump flow orifices 212 of the spool valve 180, and the drive piston passage 196 is substantially fluidly isolated from the drain flow passage 198. In embodiments, the spool valve 180 is configured such that the extended fill position is a sufficient distance away in the fill direction 228 from the initial establishment of fluid communication between the pump flow passage 194 and the drive piston passage 196 to allow an extended dwell period of time, in which the hydraulic pilot actuator is de-energized and the spool valve is returning from the extended fill position to the drain position, to elapse yet fluid communication is maintained between the pump flow passage 194 and the drive piston passage 196.

The hydraulic pilot actuator 182 is in fluid communication with the source of hydraulic fluid 152 and the spool valve 180. The hydraulic pilot actuator 182 is in electrical communication with the electronic control module 150. The hydraulic pilot actuator 182 is configured, in response to receiving a command signal from the electronic control module 150, to direct a pilot flow of hydraulic fluid to move the spool valve 180 from the drain position to the extended fill position.

The hydraulic pilot actuator 182 includes a solenoid 240, an armature 242, a pilot valve 244, and a pilot valve spring 246. A pilot housing block 248 defines a pilot cavity 250 within which the components of the hydraulic pilot actuator 182 are disposed. The pilot housing block 248 also defines various hydraulic fluid passages, including a pilot fill flow passage 252, a spool passage 254, and a pilot drain flow passage 256. The hydraulic pilot actuator 182 is in communication with the source of hydraulic fluid 152 via the pilot fill flow passage 252, with the spool valve 180 via the spool passage 254, and with the hydraulic drain via the pilot drain flow passage 256.

The pilot valve 244 is mounted to the armature 242 such that the armature 242 and the pilot valve 244 are coupled together and movably disposed within the pilot cavity 250 over a range of travel between a pilot fill position (as shown in FIG. 4) and a pilot drain position (in which the pilot valve 244 is lifted upwardly from its pilot fill position). The pilot valve spring 246 biases the pilot valve 244 to the pilot fill position. The pilot valve 244 moves to the pilot drain position in response to energizing the solenoid 240. The electrical excitation of the solenoid 240 creates a magnetic field that overcomes the biasing force exerted by the pilot valve spring 246 and draws the armature 242 and the pilot valve 244 upward to the pilot drain position. The electronic control module 150 is configured to selectively energize the solenoid 240. Accordingly, the pilot valve 244 moves back to the pilot fill position when the solenoid 240 is de-energized by virtue of the spring force exerted by the pilot valve spring 246.

When the pilot valve 244 is in the pilot fill position, the pilot fill flow passage 252 is in fluid communication with the spool passage 254 through the pilot valve 244, and the pilot drain flow passage 256 is substantially fluidly isolated from the spool passage 254 via the pilot valve 244. When the pilot valve 244 is in the pilot drain position, the spool passage 254 is in fluid communication with the pilot drain flow passage 256, and the pilot fill flow passage 252 is substantially fluidly isolated from the spool passage 254 via the pilot valve 244. The hydraulic pilot actuator 182 can be configured to substantially fluidly isolate the pilot fill flow passage 252 and the pilot drain flow passage 256 from each other.

The drive cylinder 184 is in fluid communication with the spool valve 180 via the drive piston passage 196. The drive piston 186 is reciprocally disposed within the drive cylinder 184. The drive piston 186 is reciprocally movable between a retracted position (as shown in FIG. 4) and an extended pump position (in which the drive piston is displaced downwardly). The drive piston 186 can be biased to the retracted position.

Referring to FIG. 3, in the illustrated embodiment, a push rod 260 of the link arm 176 is arranged with a distal end 262 of the drive piston 186. A drive piston spring 264 is arranged with the push rod 260 to urge the push rod 260 against the distal end 262 of the drive piston 186 to bias the drive piston 186 to the retracted position.

The drive piston 186 is linked to the cryo-plunger assembly 178 via the link arm 176. The push rod 260 is coupled to the remainder of the link arm 176 such that, when the drive piston 186 moves from the retracted position to the extended pump position, the push rod 260 translates downwardly. The remainder of the link arm 176 also moves downwardly in response to the movement of the push rod 260 to actuate the cryo-plunger assembly 178. In embodiments, the drive piston 186 can be configured as an intensifier piston which provides increased outlet pressure to the cryo-plunger assembly 178 via the link arm 176.

Figure 5:
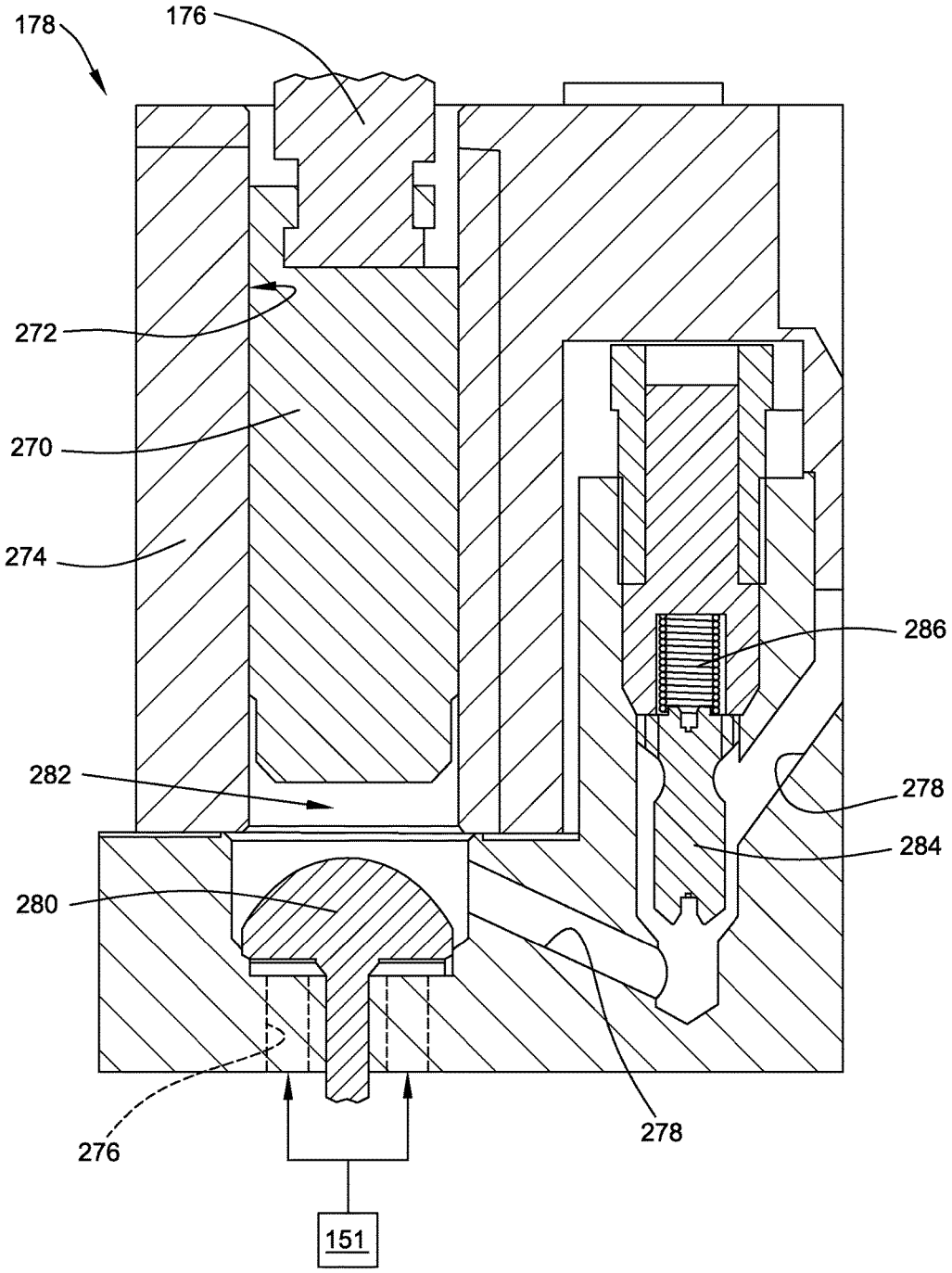
FIG. 5 is an enlarged detail view of a portion of a cold end of the cryogenic pump of FIG. 3.

Referring to FIGS. 2 and 5, the cryo-plunger assembly 178 is in communication with the supply of liquid natural gas 151. In embodiments, the cryo-plunger assembly 178 is disposed within the cryo-tank 153. The cryo-plunger assembly 178 is operably linked to the drive piston 186 such that, in response to the drive piston 186 moving to the extended pump position, the cryo-plunger assembly 178 is actuated to perform a pump stroke to compress at least some of the supply of liquid natural gas. In other embodiments, the cryo-plunger assembly 178 is disposed external to the cryo-tank 153 and is configured to receive a transfer flow of LNG from the cryo-tank 153 via a suitable mechanism, such as a transfer pump, for example.

Referring to FIG. 5, the illustrated cryo-plunger assembly 178 includes a cryo-plunger 270 reciprocally disposed within a cryo-cylinder 272 defined within a cryo-housing 274. The cryo-plunger 270 is coupled to the link arm 176 such that movement of the link arm 176 causes the cryo-plunger 270 to move correspondingly. The cryo-housing 274 defines a number of passages therein, including a LNG passage 276 and a CNG passage 278. The LNG passage 276 and the CNG passage 278 are independently in fluid communication with the cryo-cylinder 272.

The LNG passage 276 can be placed in fluid communication with the supply of LNG 151. A cryo-valve 280 is movably disposed within the LNG passage 276 to selectively occlude the LNG passage 276. In embodiments, the cryo-valve 280 can be biased to the occluded position, shown in FIG. 5. The cryo-plunger 270 and the cryo-valve 280 define a LNG cavity 282 therebetween. During a suction stroke, the cryo-valve 280 can be displaced upwardly in response to a vacuum created in the LNG cavity 282 by the upward movement of the cryo-plunger 270, thereby allowing LNG to enter the LNG cavity 282 through the LNG passage 276.

A check valve 284 can be placed in the CNG passage 278. The check valve 284 can be configured to permit LNG present in the LNG cavity 282 to exit the cryo-plunger assembly 178 (in a compressed state) via the CNG passage 278 but to prevent the reverse flow of CNG into the LNG cavity 282 through the CNG passage 278. The check valve 284 can move to an open position (as shown in FIG. 5) in response to the cryo-plunger 270 compressing LNG in the LNG cavity 282 during a pump stroke of the cryo-plunger assembly 178. A check valve spring 286 can urge the check valve 284 to the occluded position during a suction stroke to occlude the CNG passage 278 to prevent the backflow of the CNG into the LNG cavity 282.

Figure 6:
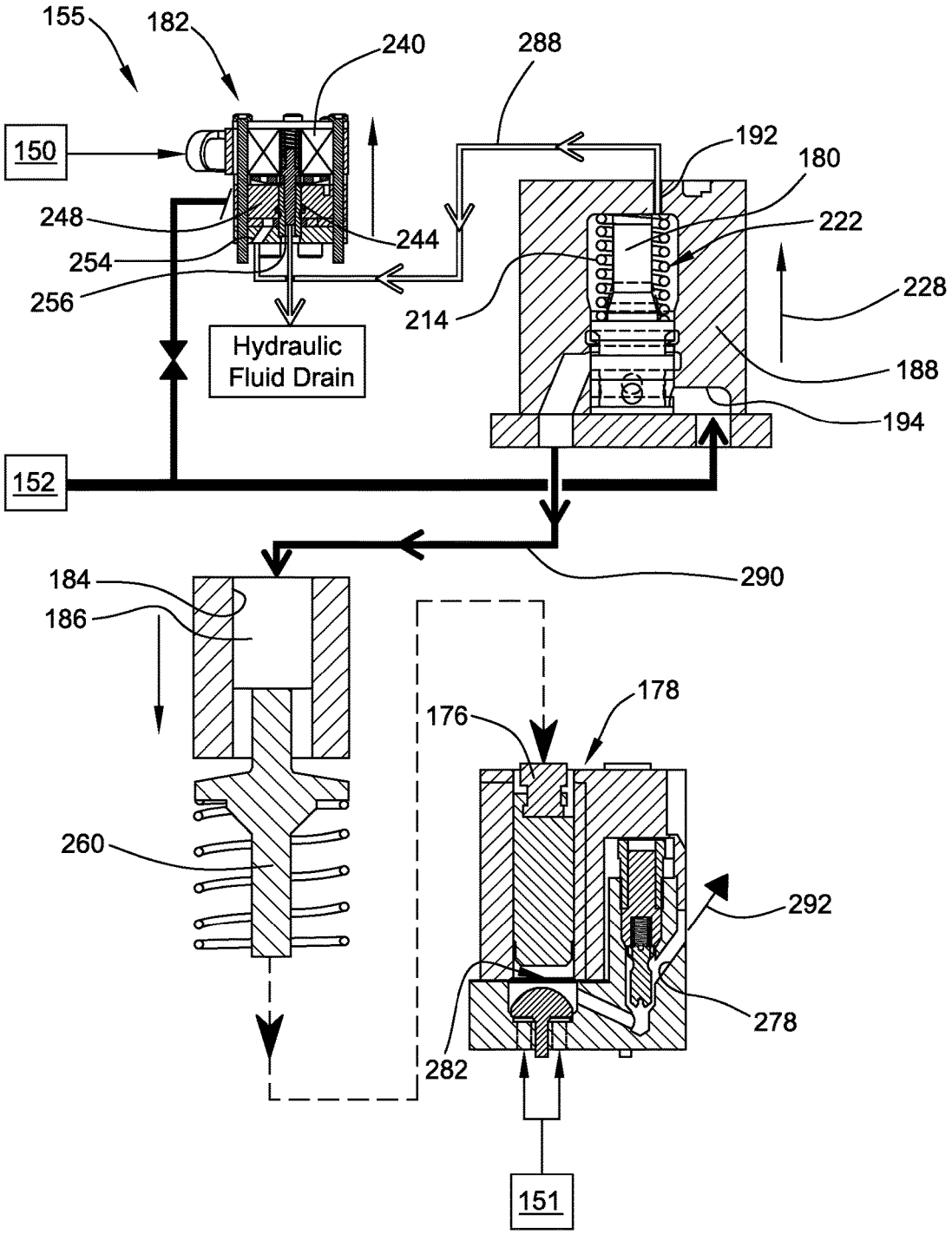
FIG. 6 is a schematic view of the operation of the cryogenic pump of FIG. 3 undergoing a pump stroke.

Referring to FIG. 6, a pump stroke of the cryogenic pump 155 is illustrated. The electronic control module 150 can be operated to energize the hydraulic pilot actuator 182, which is in fluid communication with the spool valve 180, to move the spool valve 180 from the drain position to the extended fill position. When the electronic control module 150 energizes the solenoid 240 of the hydraulic pilot actuator 182, the pilot valve 244 moves from the fill position to the drain position, thereby opening a spool drain path 288: from the pilot cavity 222 of the spool block 188; through the pilot passage 192 of the spool block 188 and the spool passage 254 and the pilot drain flow passage 256 of the pilot housing block 248; and to the hydraulic fluid drain.

Accordingly, hydraulic fluid disposed in the pilot cavity 222, which is maintaining the spool valve 180 in the drain position, flows out of the pilot cavity 222 along the spool drain path 288 when the solenoid 240 is energized by the electronic control module 150. Once a sufficient amount of the hydraulic fluid stored in the pilot cavity 222 is discharged therefrom, the pressure of the source of hydraulic fluid 152 acting upon the spool valve 180 in the pump flow passage 194 becomes greater than that exerted by the spool valve spring 214 and any remaining amount of hydraulic fluid in the pilot cavity 222 such that the spool valve 180 moves in the fill direction 228 from the drain position toward the extended fill position (shown in broken lines in FIG. 6).

In response to the spool valve 180 being displaced from the drain position, a pump flow 290 of hydraulic fluid is directed through the spool valve 180 to the drive cylinder 184 such that the pump flow 290 of hydraulic fluid acts against the drive piston reciprocally disposed within the drive cylinder 184 to move the drive piston 186 from the retracted position to the extended pump position. The drive piston 186 is linked to the cryo-plunger assembly 178 via the push rod 260 of the link arm 176. In response to the drive piston 186 moving to the extended pump position, the cryo-plunger assembly 178 is actuated to perform a pump stroke to compress at least some of the supply of liquid natural gas 151 disposed within the LNG cavity 282. A flow of CNG 292 is thereby discharged from the CNG passage 278.

Figure 7:
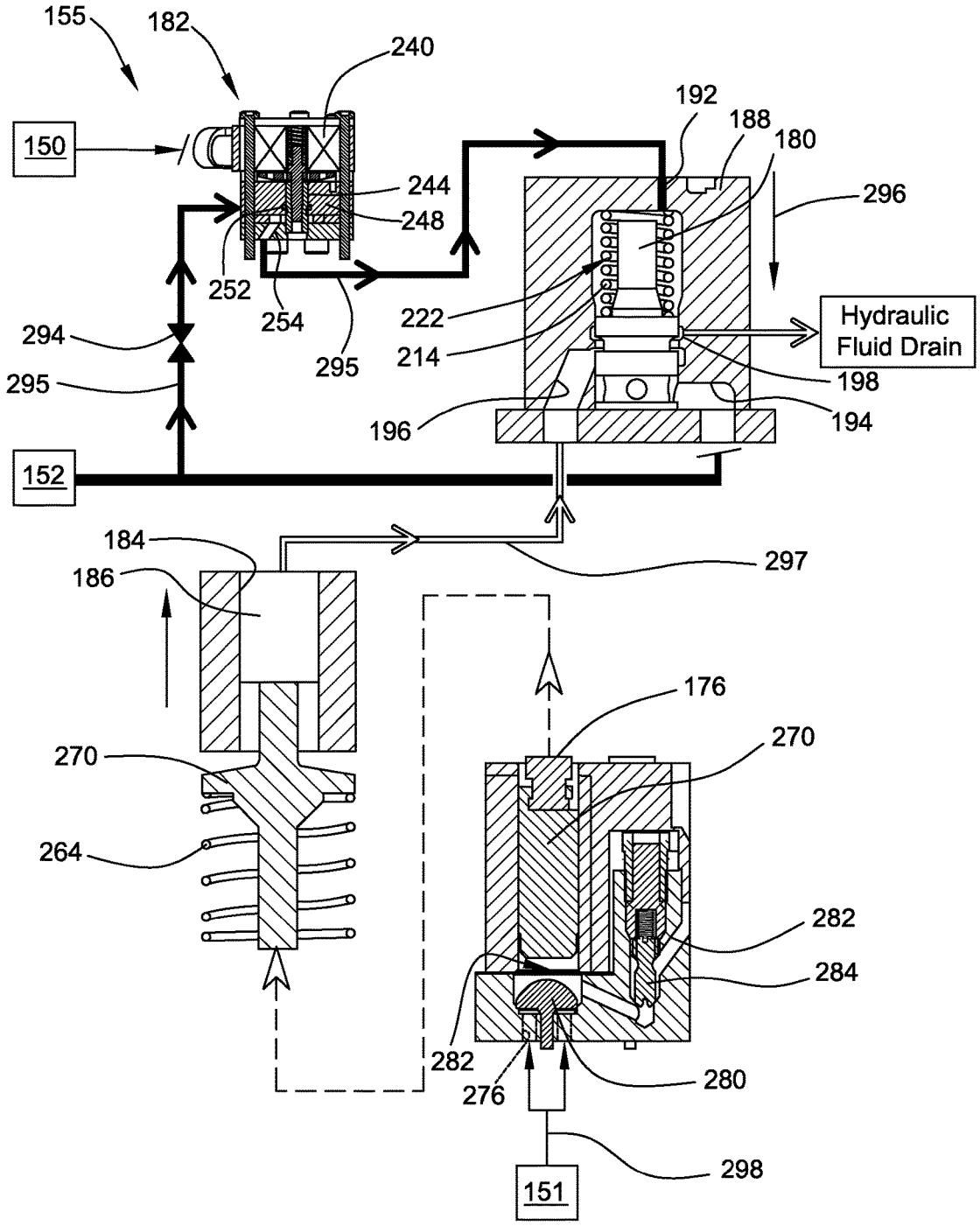
FIG. 7 is a schematic view of the operation of the cryogenic pump of FIG. 3 undergoing a suction stroke.

Referring to FIG. 7, a suction stroke of the cryogenic pump 155 is illustrated. In embodiments, the electronic control module 150 is configured to de-energize the hydraulic pilot actuator 182 after an energizing period of time has elapsed. In at least one of such embodiments, the cryogenic pump system 100 further includes a fill orifice 294. The fill orifice 294 is in fluid communication with the hydraulic pilot actuator 182. The fill orifice 294 can be configured to control a rate of spool return of the spool valve 180 from the extended fill position to the drain position after the hydraulic pilot actuator 182 is de-energized such that the drive piston 186 is in the full stroke pump position after a dwell period of time has elapsed, which occurs after the energizing period of time.

In embodiments, the extended fill position is further from the drain position than a reference fill position of the spool valve 180 in which the drive piston 186 is in the full stroke pump position after the hydraulic pilot actuator 182 is energized throughout a reference period of time. In embodiments, the reference fill position is a location closest to the drain position in which the drive piston 186 is in the extended pump position with the hydraulic pilot actuator 182 being energized throughout the reference period of time. The reference period of time is equal to a combined sum of the energizing period of time and the dwell period of time.

The electronic control module 150 can be controlled to de-energize the hydraulic pilot actuator 182 to move the spool valve 180 from the extended fill position to the drain position. When the solenoid 240 of the hydraulic pilot actuator 182 is de-energized, the pilot valve 244 moves from the drain position to the fill position, thereby opening a spool fill path 295: from the source of hydraulic fluid 152; through the pilot fill flow passage 252 and the spool passage 254 of the pilot housing block 248 and the pilot passage 192 of the spool block 188; and into the pilot cavity 222 of the spool block 188.

Accordingly, hydraulic fluid from the source of hydraulic fluid 152 flows along the spool fill path 295 into the pilot cavity 222 when the solenoid 240 is de-energized. Once a sufficient amount of hydraulic fluid is stored in the pilot cavity 222, the pressure of the hydraulic fluid in the pilot cavity 222 and the spool valve spring 214 acting upon the spool valve 180 becomes greater than that exerted by the source of hydraulic fluid 152 in the pump flow passage 194 such that the spool valve 180 moves in a drain direction 296 from the extended fill position to the drain position.

In embodiments, the fill orifice 294 can be configured to control the flow of hydraulic fluid along the spool fill path 295 to achieve a desired rate of spool return of the spool valve 180 from the extended fill position to the drain position. In embodiments, a variable-sized fill orifice 294 can be used. In embodiments, a different mechanism other than a fill orifice can be used to control the rate of spool return, as will be appreciated by one skilled in the art.

In response to the spool valve 180 being returned to the drain position, a drive cylinder drain path 297 is opened such that hydraulic fluid is directed: from the drive cylinder 184, through the spool valve 180 and the drive piston passage 196 and the drain flow passage 198 of the spool block 188, and to the hydraulic fluid drain. Once a sufficient amount of the hydraulic fluid in the drive cylinder 184 exits therefrom along the drive cylinder drain path 297, the drive piston spring 264 acts to urge the drive piston 186 to the retracted position. In response to the push rod 260 moving the drive piston 186 from the extended pump position to the retracted position, the cryo-plunger 270 moves upwardly, as well, by virtue of the upward translation of the remainder of the link arm 176 with the upward movement of the push rod 260. The upward movement of the cryo-plunger 270 generates a vacuum within the LNG cavity 282, which in turn, unseats the cryo-valve 280 to allow a flow of LNG 298 from the supply of LNG 151 to enter the LNG cavity 282 through the LNG passage 276. The check valve 284 prevents CNG from entering the LNG cavity 282 via the CNG passage 278.

In other embodiments, the fill orifice 294 (or other mechanism to slow the rate of spool return of the spool valve 180) can be omitted. In such embodiments, the electronic control module 150 can be configured to energize the hydraulic pilot actuator 182 for a plurality of energizing periods of time via a command signal to direct the pilot flow of hydraulic fluid along the spool drain path 288 to move the spool valve 180 in the fill direction 228 from the drain position to the extended fill position.

The electronic control module 150 can be configured to allow an intervening dwell period of time to elapse between each successive pair of the plurality of energizing periods of time. The hydraulic pilot actuator 182 is un-energized during each intervening dwell period of time. The spool valve 180 moves in the drain direction 296 from the extended fill position toward the drain position during each intervening dwell period of time. The electronic control module 150 can be configured to de-energize the hydraulic pilot actuator 182 after a final energizing period of the plurality of energizing periods of time has elapsed.

In embodiments, the plurality of energizing periods of time and each intervening dwell period of time are configured such that the drive piston 186 is in the extended pump position after a residual dwell period of time has elapsed. The residual dwell period of time occurs after the final energizing period of the plurality of energizing periods of time has elapsed.

In embodiments, the extended fill position is further from the drain position than a reference fill position of the spool valve 180 in which the drive piston 186 is in the extended pump position after the hydraulic pilot actuator 182 is energized throughout a reference period of time. In embodiments, the reference fill position is a location closest to the drain position in which the drive piston 186 is in the extended pump position with the hydraulic pilot actuator 182 being energized throughout the reference period of time. The reference period of time is equal to a combined sum of the plurality of energizing periods of time, each intervening dwell period of time, and the residual dwell period of time.

In embodiments of a method of operating a cryogenic pump following principles of the present disclosure, a cryogenic pump control strategy can be employed to reduce the power draw of the cryogenic pump system. In embodiments, a method of operating a cryogenic pump following principles of the present disclosure can be used with any embodiment of a cryogenic pump system according to principles of the present disclosure. In embodiments, the electronic control module of the cryogenic pump system can be configured to carry out steps of any method of operating a cryogenic pump following principles of the present disclosure. In embodiments, the cryogenic pump can be operated in other suitable applications.

Figure 8:
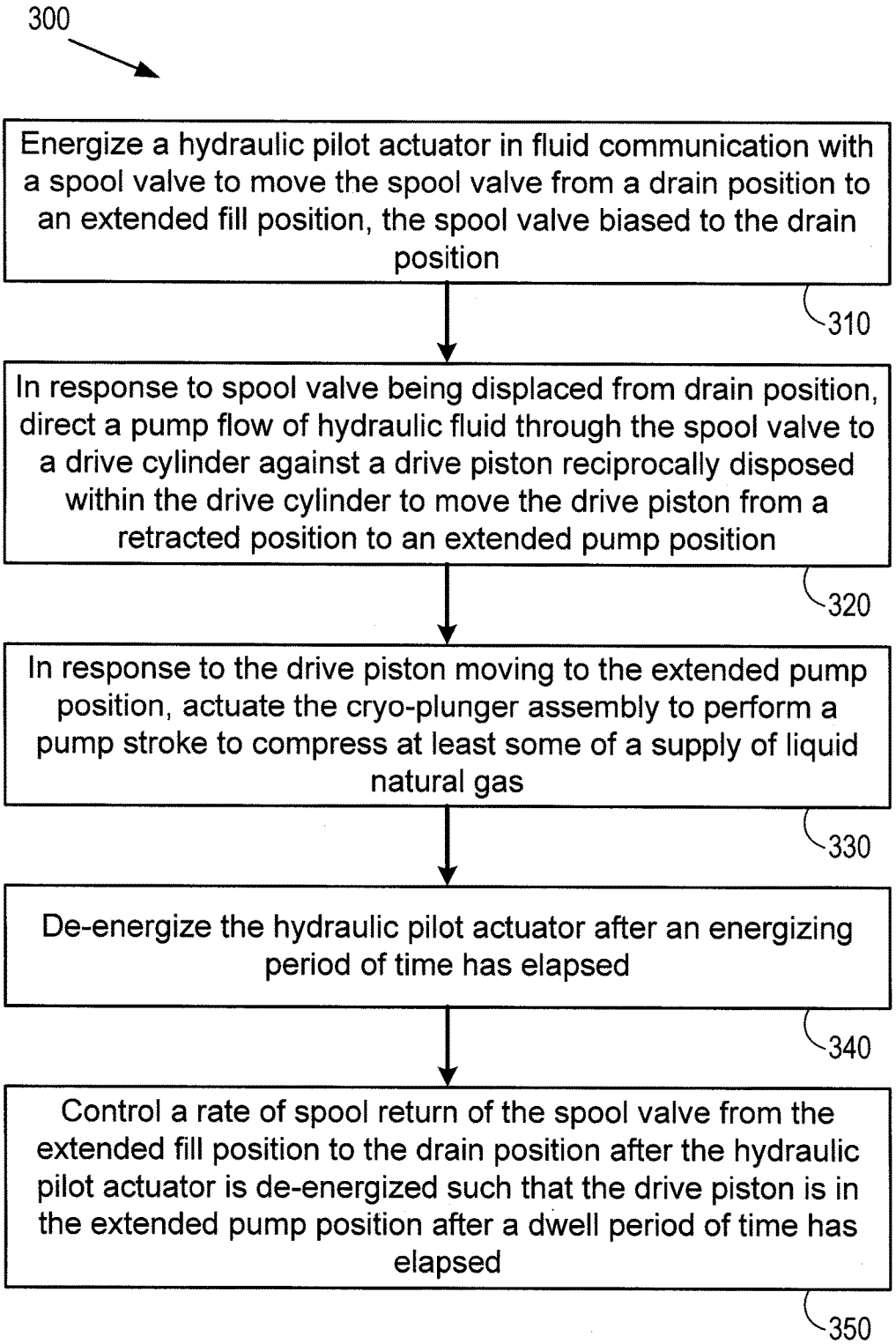
FIG. 8 is a flowchart illustrating steps of an embodiment of a method of operating a cryogenic pump following principles of the present disclosure.

In embodiments, a method of operating a cryogenic pump following principles of the present disclosure can include a shorter duration pilot actuation period combined with an extended spool lift and an orifice-controlled "slow" spool return in which the spool valve does not cut off hydraulic flow to the pumping element until the pumping event is complete. Referring to FIG. 8, steps of an embodiment of a method 300 of operating a cryogenic pump following principles of the present disclosure are shown.

The method 300 of operating includes energizing a hydraulic pilot actuator in fluid communication with a spool valve to move the spool valve from a drain position to an extended fill position (step 310). The spool valve is biased to the drain position.

In response to the spool valve being displaced from the drain position, a pump flow of hydraulic fluid is directed through the spool valve to a drive cylinder such that the pump flow of hydraulic fluid acts against a drive piston reciprocally disposed within the drive cylinder to move the drive piston from a retracted position to an extended pump position. The drive piston is linked to a cryo-plunger assembly which is in communication with a supply of liquid natural gas (step 320). In embodiments, the drive piston is biased to the retracted position. In response to the drive piston moving to the extended pump position, the cryo-plunger assembly is actuated to perform a pump stroke to compress at least some of the supply of liquid natural gas (step 330).

The hydraulic pilot actuator is de-energized after an energizing period of time has elapsed (step 340). A rate of spool return of the spool valve from the extended fill position to the drain position is controlled after the hydraulic pilot actuator is de-energized such that the drive piston is in the extended pump position after a dwell period of time after the energizing period of time has elapsed (step 350). In embodiments, the rate of spool return is controlled using a fill orifice in fluid communication with the hydraulic pilot actuator. In other embodiments, another suitable mechanism for controlling the rate of spool return is used.

In embodiments, the extended fill position is further from the drain position than a reference fill position of the spool valve in which the drive piston is in the extended pump position after the hydraulic pilot actuator is energized throughout a reference period of time. In embodiments, the reference fill position is a location closest to the drain position in which the drive piston is in the extended pump position with the hydraulic pilot actuator being energized throughout a reference period of time. The reference period of time is equal to a combined sum of the energizing period of time and the dwell period of time.

In embodiments, the energizing period of time is less than half of the dwell period of time. In yet other embodiments, the energizing period of time is less than one-third of the dwell period of time. For example, in one embodiment, the energizing period of time is about 9 ms, the dwell period of time is about 21 ms, and the reference period of time is about 30 ms.

The reference fill position has a reference distance from the drain position, and the extended fill position has an extended distance from the drain position. In embodiments, the reference distance is in a range between fifty percent and ninety percent of the extended distance, and in a range between fifty percent and seventy-five percent of the extended distance in yet other embodiments. For example, in one embodiment, the reference distance is about sixty percent of the extended distance. In some of such embodiments, the reference distance is about 3 millimeters and the extended fill position is about 5 millimeters.

Figure 9:
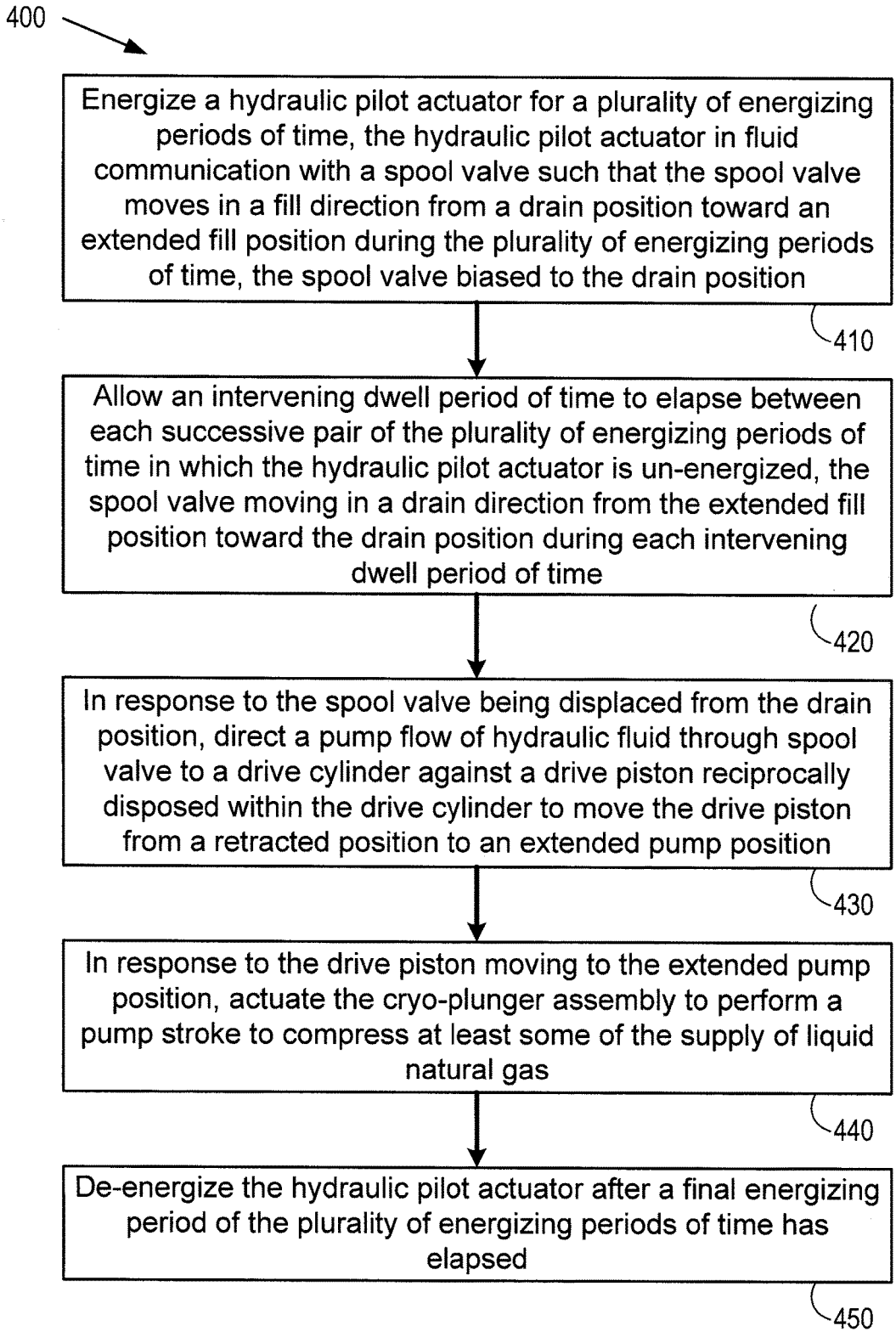
FIG. 9 is a flowchart illustrating steps of another embodiment of a method of operating a cryogenic pump following principles of the present disclosure.

In embodiments, a method of operating a cryogenic pump following principles of the present disclosure can include a combination of an extended spool lift and multiple shorter pilot shots that oscillate the spool valve near its end of travel before allowing it to return to the drain position and cut off hydraulic flow to the pumping element until the pumping event is complete. Referring to FIG. 9, steps of an embodiment of a method 400 of operating a cryogenic pump following principles of the present disclosure are shown.

The method 400 of operating includes energizing a hydraulic pilot actuator for a plurality of energizing periods of time (step 410). The hydraulic pilot actuator is in fluid communication with a spool valve such that the spool valve moves in a fill direction from a drain position toward an extended fill position during the plurality of energizing periods of time. The spool valve is biased to the drain position.

An intervening dwell period of time is allowed to elapse between each successive pair of the plurality of energizing periods of time (step 420). The hydraulic pilot actuator is un-energized during each intervening dwell period of time. The spool valve moves in a drain direction from the extended fill position toward the drain position during each intervening dwell period of time.

In embodiments, any suitable number of energizing periods of time and intervening dwell period of time can be used. For example, in some embodiments, the plurality of energizing periods of time comprises only two energizing periods of time, and a single intervening dwell period of time is interposed between the first energizing period of time and the second energizing period of time. In yet other embodiments, more than two energizing periods of time can be used with a corresponding number of intervening dwell periods of time (one less than the number of energizing periods of time).

In embodiments, each of the plurality of energizing period of time is substantially the same. In yet other embodiments, at least one of the energizing periods of time is different from at least one other energizing period of time. In embodiments, each intervening dwell period of time is greater than at least one of the plurality of energizing periods of time.

In embodiments, a first sum of the plurality of energizing periods of time is less than half of a second sum of each intervening dwell period of time and the residual dwell period of time. In at least one of such embodiments, the first sum is less than one-third of the second sum. In at least one of such embodiments, each intervening dwell period of time is greater than the first sum.

For example, in embodiments, two energizing periods of time are used, and each energizing period of time is about 3 ms. An intervening dwell period of time is about 12 ms, and the residual dwell period of time is about 12 ms. Accordingly, the first sum of the energizing periods of time is about 6 ms, and the second sum of the intervening dwell period of time and the residual dwell period of time is about 24 ms. In such embodiments, the first sum is about one-quarter of the second sum.

In response to the spool valve being displaced from the drain position, a pump flow of hydraulic fluid is directed through the spool valve to a drive cylinder such that the pump flow of hydraulic fluid acts against a drive piston reciprocally disposed within the drive cylinder to move the drive piston from a retracted position to an extended pump position (step 430). The drive piston is linked to a cryo-plunger assembly. The cryo-plunger assembly is in communication with a supply of liquid natural gas. In response to the drive piston moving to the extended pump position, the cryo-plunger assembly is actuated to perform a pump stroke to compress at least some of the supply of liquid natural gas (step 440).

The hydraulic pilot actuator is de-energized after a final energizing period of the plurality of energizing periods of time has elapsed (step 450). The plurality of energizing periods of time and each intervening dwell period of time are configured such that the drive piston is in the extended pump position after a residual dwell period of time has elapsed. The residual dwell period of time occurs after the final energizing period of the plurality of energizing periods of time has elapsed.

In embodiments, the extended fill position is further from the drain position than a reference fill position of the spool valve in which the drive piston is in the extended pump position after the hydraulic pilot actuator is energized throughout a reference period of time. The reference period of time is equal to a combined sum of the plurality of energizing periods of time, each intervening dwell period of time, and the residual dwell period of time. In embodiments, the spool valve is disposed between the reference fill position and the extended fill position after each intervening dwell period of time has elapsed.

The reference fill position has a reference distance from the drain position, and the extended fill position has an extended distance from the drain position. In embodiments, the reference distance is in a range between fifty percent and ninety percent of the extended distance, and in a range between fifty percent and seventy-five percent of the extended distance in yet other embodiments. For example, in one embodiment, the reference distance is about sixty percent of the extended distance. In some of such embodiments, the reference distance is about 3 millimeters and the extended fill position is about 5 millimeters.

Example

Figure 10:
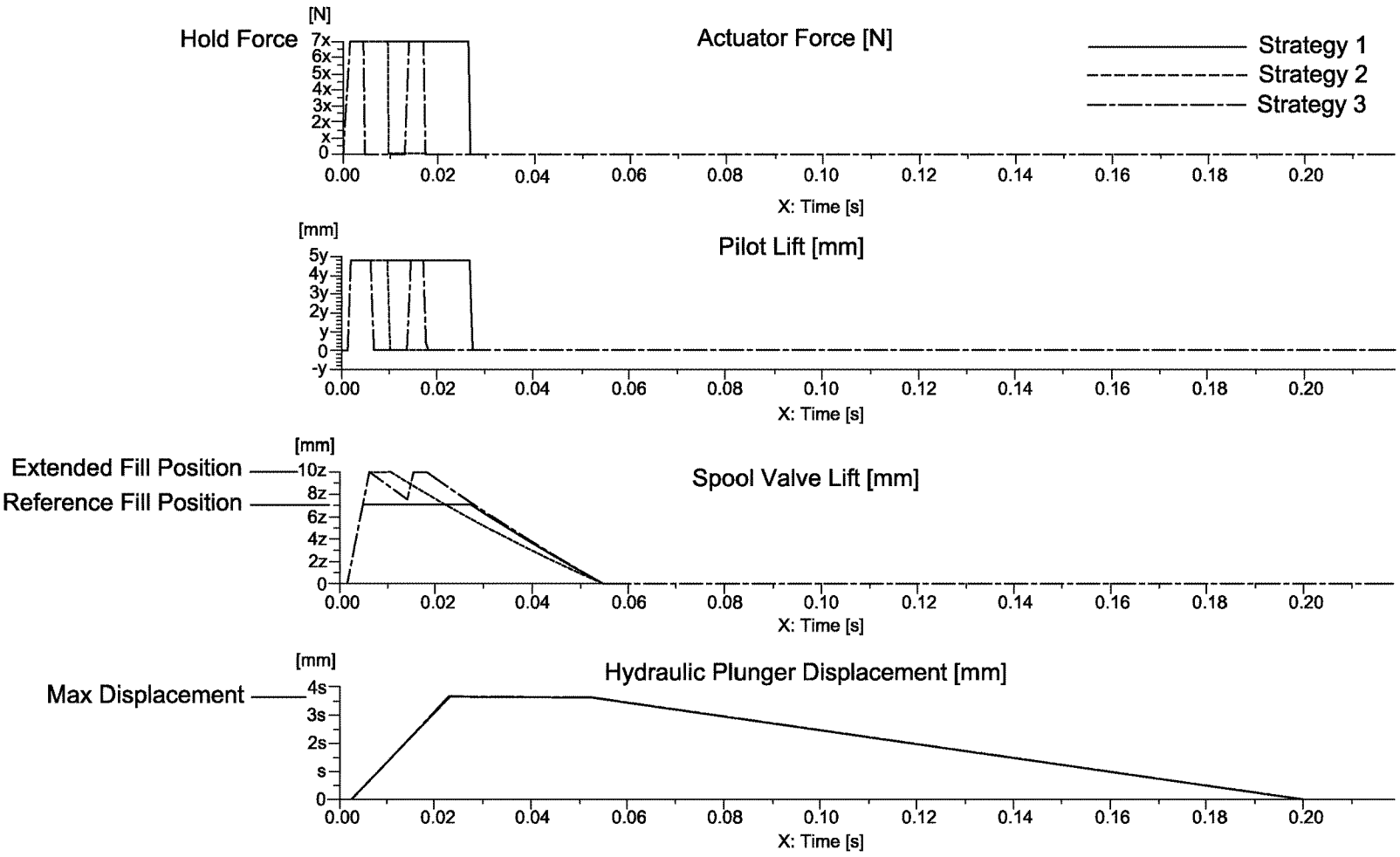
FIG. 10 are plots of pilot actuator force, pilot lift, spool valve lift, and hydraulic plunger (drive piston) displacement over time for embodiments of a method of operating a cryogenic pump following principles of the present disclosure and a baseline reference approach.

Referring to FIG. 10, different actuator/spool strategies are shown which accomplish the same drive piston motion. The Example illustrates that using a method of operating a cryogenic pump following principles of the present disclosure can reduce the power draw per pumping event by one half or more relative to the reference strategy.

Strategy 1 reflects the reference strategy in which the hydraulic pilot actuator is energized to move the spool valve to a reference fill position (about 3.5 mm) and held in place for the entire reference period (about 30 ms). An actuation event is a combination of a pull-in phase and a hold phase of the armature of the hydraulic pilot actuator, and each phase has a different power demand. The power calculation for Strategy 1 is as follows:

Pull in Power=4.4V×3 A=13.2V·A
Pull in Duration=0.5 ms
Hold Power=V×A=V·A
Hold Duration (Pump Stroke): 29.5 ms
Strategy 1 Power Demand: (13.2V·A×(0.5 ms)+V·A×(29.5 ms))/(30 ms)=1.2V·A watts average power per event.

Strategy 2 is an example of the method 300 of operating a cryogenic pump described with reference to FIG. 8. In this Example, the hydraulic pilot actuator period is energized for an energizing period of time of about 8.5 ms in which time the spool valve is moved to an extended fill position of about 5 mm. The rate of spool return of the spool valve from the extended fill position to the drain position is controlled by a fill orifice. The dwell period of time is about 21.5 ms. As shown in the plots of FIG. 10, Strategy 2 generates substantially the same hydraulic plunger (drive piston) displacement as that generated by Strategy 1.

However, Strategy 2 has a reduced power demand relative to Strategy 1 (slightly less than half). Strategy 2 has the same pull-in power demand of Strategy 1, but a reduced hold power demand. The power calculation of Strategy 2 is calculated as follows:

Pull in Power=4.4V×3 A=13.2V·A
Pull in Duration=0.5 ms
Hold Power=V×A=V·A
Hold Duration=8 ms
Strategy 2 Power Demand: (13.2V·A×(0.5 ms)+V·A×(8 ms))/(30 ms)=0.49 V·A watts average power per event.

Strategy 3 is an example of the method 400 of operating a cryogenic pump described with reference to FIG. 9. In this Example, the hydraulic pilot actuator period is energized for two energizing periods of time, with each energizing period of time being about 3 ms. An intervening dwell period of time of about 12 ms is interposed between first and second energizing periods of time, and the residual dwell period of time is about 12 ms. During each energizing period of time, the spool valve is moved to an extended fill position of about 5 mm. The cryogenic pump system does not include a mechanism for controlling the rate of spool return from the extended fill position back to the drain position. As shown in the plots of FIG. 10, Strategy 3 generates substantially the same hydraulic plunger (drive piston) displacement as that generated by Strategy 1.

However, Strategy 3 has a reduced power demand relative to Strategy 1 (about sixty percent). Strategy 3 has twice the pull-in power demand of Strategy 1 because the armature is pulled in during each energizing period of time, but has a reduced hold power demand during the aggregated energizing periods of time as compared to the hold duration in Strategy 1. The power calculation of Strategy 3 is calculated as follows:

Pull in Power=4.4V×3 A=13.2V·A
Pull in Duration=0.5 ms×2=1 ms
Hold Power=V×A=V·A
Hold Duration=2.5 ms×2=5 ms
Strategy 3 Power Demand: (13.2V·A×(1.0 ms)+V·A×(5 ms))/(30 ms)=0.6V·A watts average power per event.

INDUSTRIAL APPLICABILITY

The industrial applicability of the embodiments of a cryogenic pump system and a method of operating a cryogenic pump as described herein will be readily appreciated from the foregoing discussion. At least one embodiment of a cryogenic pump system constructed according to principles of the present disclosure can be used in an engine to help operate the engine with a reduced power demand. Embodiments of a cryogenic pump system according to principles of the present disclosure may find potential application in any suitable engine. Exemplary engines include a dual fuel compression ignition engine.

In embodiments of a method of operating a cryogenic pump following principles of the present disclosure, a cryogenic pump control strategy can be employed to reduce the power draw of the cryogenic pump system. The reduced demand on the power supply can be particularly helpful in applications where the cryogenic pump system is used in a mobile machine and can help reduce the harm to components of the cryogenic pump system caused by excessive heating thereof (e.g., the solenoid of a hydraulic pilot actuator).

In embodiments, a method of operating a cryogenic pump following principles of the present disclosure can reduce the power draw per pumping event by about one half or more relative to a reference strategy in which the hydraulic pilot actuator is energized during the entire pumping event. The reduced power demand may lead to a reduction in the average solenoid temperature during operation. These strategies may allow the use of the robust hydraulic pilot actuator in a cryogenic pump application by reducing power draw and heat load on the actuators.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A method of operating a cryogenic pump comprising:

energizing a hydraulic pilot actuator for a plurality of energizing periods of time, the hydraulic pilot actuator in fluid communication with a spool valve such that the spool valve moves in a fill direction from a drain position toward an extended fill position during the plurality of energizing periods of time, the spool valve biased to the drain position;

allowing an intervening dwell period of time to elapse between each of the plurality of energizing periods of time, the hydraulic pilot actuator being un-energized during each intervening dwell period of time, the spool valve moving in a drain direction from the extended fill position toward the drain position during each intervening dwell period of time;

in response to the spool valve being displaced from the drain position, directing a pump flow of hydraulic fluid through the spool valve to a drive cylinder such that the pump flow of hydraulic fluid acts against a drive piston reciprocally disposed within the drive cylinder to move the drive piston from a retracted position to an extended pump position, the drive piston linked to a cryo-plunger assembly, the cryo-plunger assembly in communication with a supply of liquid natural gas;

in response to the drive piston moving to the extended pump position, actuating the cryo-plunger assembly to perform a pump stroke to compress at least some of the supply of liquid natural gas;

de-energizing the hydraulic pilot actuator after a final energizing period of the plurality of energizing periods of time has elapsed;

wherein the plurality of energizing periods of time and each intervening dwell period of time are configured such that the drive piston is in the extended pump position after a residual dwell period of time has elapsed, the residual dwell period of time occurring after the final energizing period of the plurality of energizing periods of time has elapsed;

wherein the extended fill position is further from the drain position than a reference fill position of the spool valve in which the drive piston is in the extended pump position after the hydraulic pilot actuator is energized throughout a reference period of time, the reference period of time equal to a combined sum of the plurality of energizing periods of time, each intervening dwell period of time, and the residual dwell period of time.

2. The method of operating according to claim 1, wherein the plurality of energizing periods of time comprises a first energizing period of time and a second energizing period of time, and a single intervening dwell period of time is interposed between the first energizing period of time and the second energizing period of time.

3. The method of operating according to claim 1, wherein the spool valve is disposed between the reference fill position and the extended fill position after each intervening dwell period of time has elapsed.

4. The method of operating according to claim 1, wherein the reference fill position has a reference distance from the drain position, and the extended fill position has an extended distance from the drain position, the reference distance being in a range between fifty percent and ninety percent of the extended distance.

5. The method of operating according to claim 1, wherein each of the plurality of energizing periods of time is substantially the same.

6. The method of operating according to claim 1, wherein each intervening dwell period of time is greater than at least one of the plurality of energizing periods of time.

7. The method of operating according to claim 1, wherein a first sum of the plurality of energizing periods of time is less than half of a second sum of each intervening dwell period of time and the residual dwell period of time.

8. The method of operating according to claim 7, wherein the first sum is less than one-third of the second sum.

9. The method of operating according to claim 8, wherein each intervening dwell period of time is greater than the first sum.

10. A cryogenic pump system, comprising:

a supply of liquid natural gas;

a source of hydraulic fluid;

a cryogenic pump, the cryogenic pump operatively arranged with the supply of liquid natural gas and the source of hydraulic fluid, the cryogenic pump configured to operate using the source of hydraulic fluid to compress at least some of the supply of liquid natural gas; and an electronic control module, the electronic control module operably arranged with the cryogenic pump and configured to selectively operate the cryogenic pump;

wherein the cryogenic pump includes:

a spool valve, the spool valve movable over a range of travel between a drain position and an extended fill position, the spool valve biased to the drain position, the spool valve in communication with the source of hydraulic fluid, a hydraulic pilot actuator, the hydraulic pilot actuator in fluid communication with the source of hydraulic fluid and the spool valve, the hydraulic pilot actuator in electrical communication with the electronic control module, the hydraulic pilot actuator configured, in response to receiving a command signal from the electronic control module, to direct a pilot flow of hydraulic fluid to move the spool valve from the drain position to the extended fill position, a drive cylinder, the drive cylinder in fluid communication with the spool valve, a drive piston, the drive piston reciprocally disposed within the drive cylinder, the drive piston reciprocally movable between a retracted position and an extended pump position, the drive piston biased to the retracted position, wherein, in response to the spool valve being displaced from the drain position, a pump flow of hydraulic fluid is directed through the spool valve to the drive cylinder such that the pump flow of hydraulic fluid acts against the drive piston to move the drive piston from the retracted position to the extended pump position, and a cryo-plunger assembly, the cryo-plunger assembly in communication with the supply of liquid natural gas, the cryo-plunger assembly operably linked to the drive piston such that, in response to the drive piston moving to the extended pump position, the cryo-plunger assembly is actuated to perform a pump stroke to compress at least some of the supply of liquid natural gas.

11. The cryogenic pump system according to claim 10, wherein the cryogenic pump includes a link arm, the drive piston being linked to the cryo-plunger assembly via the link arm.

12. The cryogenic pump system according to claim 10, further comprising:

a cryo-tank, the supply of liquid natural gas being stored in the cryo-tank, and the cryo-plunger assembly being disposed within the cryo-tank.

13. The cryogenic pump system according to claim 10, wherein the electronic control module is configured to de-energize the hydraulic pilot actuator after an energizing period of time has elapsed, the cryogenic pump system further comprising:

a fill orifice, the fill orifice in fluid communication with the hydraulic pilot actuator, the fill orifice configured to control a rate of spool return of the spool valve from the extended fill position to the drain position after the hydraulic pilot actuator is de-energized such that the drive piston is in the extended pump position after a dwell period of time after the energizing period of time has elapsed, wherein the extended fill position is further from the drain position than a reference fill position of the spool valve in which the drive piston is in the extended pump position after the hydraulic pilot actuator is energized throughout a reference period of time, the reference period of time equal to a combined sum of the energizing period of time and the dwell period of time.

14. The cryogenic pump system according to claim 10, wherein the electronic control module is configured to:

energize the hydraulic pilot actuator for a plurality of energizing periods of time via the command signal to direct the pilot flow of hydraulic fluid into the spool valve to move the spool valve in a fill direction from the drain position to the extended fill position, the spool valve biased to the drain position, allow an intervening dwell period of time to elapse between each of the plurality of energizing periods of time, the hydraulic pilot actuator being un-energized during each intervening dwell period of time, the spool valve moving in a drain direction from the extended fill position toward the drain position during each intervening dwell period of time, de-energize the hydraulic pilot actuator after a final energizing period of the plurality of energizing periods of time has elapsed, wherein the plurality of energizing periods of time and each intervening dwell period of time are configured such that the drive piston is in the extended pump position after a residual dwell period of time has elapsed, the residual dwell period of time occurring after the final energizing period of the plurality of energizing periods of time has elapsed, and wherein the extended fill position is further from the drain position than a reference fill position of the spool valve in which the drive piston is in the extended pump position after the hydraulic pilot actuator is energized throughout a reference period of time, the reference period of time equal to a combined sum of the plurality of energizing periods of time, each intervening dwell period of time, and the residual dwell period of time.

* * * * *